US011525102B2

(12) United States Patent
Nelson et al.

(10) Patent No.: US 11,525,102 B2
(45) Date of Patent: Dec. 13, 2022

(54) METAL-WORKING FLUID COMPOSITIONS AND METHODS FOR MAKING

(71) Applicant: Kraton Polymers LLC, Houston, TX (US)

(72) Inventors: Lloyd Nelson, Savannah, GA (US); Roy Gerritsen, Almere (NL); Pieter Eduard, Almere (NL)

(73) Assignee: KRATON POLYMERS LLC, Houston, TX (US)

( * ) Notice: Subject to any disclaimer, the term of this patent is extended or adjusted under 35 U.S.C. 154(b) by 0 days.

(21) Appl. No.: 17/644,496

(22) Filed: Dec. 15, 2021

(65) Prior Publication Data

US 2022/0195326 A1 Jun. 23, 2022

Related U.S. Application Data

(60) Provisional application No. 63/199,339, filed on Dec. 21, 2020.

(51) Int. Cl.

| | |
|---|---|
| ***C10M 173/00*** | (2006.01) |
| ***C10M 177/00*** | (2006.01) |
| *C10N 50/00* | (2006.01) |
| *C10N 70/00* | (2006.01) |
| *C10N 30/00* | (2006.01) |
| *C10N 30/02* | (2006.01) |
| *C10N 30/20* | (2006.01) |
| *C10N 40/20* | (2006.01) |

(52) U.S. Cl.

CPC ..... *C10M 173/00* (2013.01); *C10M 177/00* (2013.01); *C10M 2203/1025* (2013.01); *C10M 2203/1065* (2013.01); *C10M 2203/1085* (2013.01); *C10M 2209/003* (2013.01); *C10N 2030/02* (2013.01); *C10N 2030/20* (2013.01); *C10N 2030/43* (2020.05); *C10N 2040/20* (2013.01); *C10N 2050/011* (2020.05); *C10N 2070/02* (2020.05)

(58) Field of Classification Search

CPC ..... C10M 173/00; C10M 177/00; C10M 2203/1025; C10M 2203/1065; C10M 2203/1085; C10M 2209/003; C10N 2030/02; C10N 2030/20; C10N 2030/43; C10N 2040/20; C10N 2050/011; C10N 2070/02

See application file for complete search history.

(56) References Cited

U.S. PATENT DOCUMENTS

| | | | | |
|---|---|---|---|---|
| 3,618,707 | A | 11/1971 | Sluhan | |
| 6,562,888 | B1 * | 5/2003 | Frihart | C09F 1/04 524/270 |
| 2008/0020957 | A1 * | 1/2008 | Nelson | C08L 93/04 524/798 |
| 2009/0209690 | A1 * | 8/2009 | Sandstrom | B60C 1/0025 152/209.1 |
| 2010/0222618 | A1 * | 9/2010 | Takagi | C10M 173/00 585/18 |
| 2019/0002733 | A1 * | 1/2019 | Schaapman | C09F 1/04 |
| 2019/0100715 | A1 * | 4/2019 | Golden | C10M 173/00 |
| 2020/0199408 | A1 * | 6/2020 | Schaapman | C09D 5/004 |
| 2021/0032500 | A1 * | 2/2021 | Alfonso | B01J 19/0053 |
| 2021/0189132 | A1 * | 6/2021 | van Herrikhuyzen | C08L 93/04 |
| 2022/0193695 | A1 * | 6/2022 | Heebner | B03D 1/006 |

FOREIGN PATENT DOCUMENTS

| | | | |
|---|---|---|---|
| EP | 0120665 | A2 | 10/1984 |
| EP | 0149958 | A2 | 7/1985 |
| GB | 560810 | A | 4/1944 |

* cited by examiner

*Primary Examiner* — Ellen M McAvoy

(57) ABSTRACT

The disclosure relates to a biobased metal-working fluid (MWF) composition and method for making same, and more particularly metal-working fluid with biobased lubricants with improved emulsion stability. At least 50 wt. % of the base oil component in the MWF concentrate is a plant-derived liquid decarboxylated rosin acid oil ("DCR"). The DCR comprises 50 to 100 wt. % of tricyclic compounds having 18-20 carbon atoms, one or more C═C groups, and m/z (mass/charge) value of 220-280; an oxygen content of <5%; a density of 0.9 to 1.0 g/cm$^3$ at 20° C.; and an acid value of <10 mg KOH/g. The resulting MWF is characterized as having comparable if not better performance compared to a MWF containing only mineral oil (e.g., Group I or Group II).

20 Claims, No Drawings

METAL-WORKING FLUID COMPOSITIONS AND METHODS FOR MAKING

RELATED APPLICATIONS

This application claims priority from U.S. Provisional Application No. 63/199,339 with a filing date of Dec. 21, 2020, the disclosures of which is incorporated herein by reference

FIELD

The disclosure relates to biobased metal-working fluid (MWF) composition and method for making same, and more particularly metal-working fluid containing decarboxylated rosin acids as lubricants with improved emulsion stability.

BACKGROUND

In metal machining processes such as cutting and grinding, a metal-working oil is used to improve machining efficiency, prevent abrasion between a workpiece and a tool to machine the work piece, prolong tool life (cool), and remove metal chips. Such metal-working fluids include an oil-based agent (base oil), e.g., mineral oil, animal and vegetable oil, or synthetic oil, water, and a surface-active compound. Metal working fluids containing mineral oil have challenges in the industry as regards being derived from petroleum oil (fossil) and the ability to be emulsified to form stable emulsions.

There exists a need for a metal working fluid which is environmentally friendly and effective to reduce friction caused by removing material from surfaces of the work piece, and dissipate the heat generated by the frictional contact between the tool and the work piece.

SUMMARY OF THE INVENTION

In one aspect, a bio-based metal-working fluid concentrate is provided. The metal-working fluid concentrate comprises: a base oil component in an amount of 5-90 wt. %, based on the total weight of the concentrate; an emulsifier selected from any of the conventional anionic, cationic, nonionic or amphoteric surfactants, in an amount of 0.1 to 15 wt. %; at least an optional additive selected from saponifiers, pH buffers, preservatives, extreme pressure EP additives, corrosion inhibitors, anti-wear agents, metal deactivators, defoamers, anti-rust agents, deodorants, dyes, fungicides, bacteriocides, antioxidants, emulsion stabilizers, dispersion stabilizers in an amount of 0.1 to 15 wt. %; wherein the base oil component contains at least 50 wt. % of a decarboxylated rosin acid (DCR) oil based on the total weight of the base oil component. The DCR oil comprises 50 to 100 wt. % of tricyclic compounds having 18-20 carbon atoms, one or more C═C groups, and m/z (mass/charge) value of 220-280, preferably 230-270, more preferably 234-262 as measured by GC-FID-MS; an oxygen content of <5%, preferably <3%, more preferably <2%, most preferably 0-1%; a density of 0.9 to 1.0 g/cm$^3$ at 20° C.; and an acid value of <50 mg KOH/g, preferably <45 mg KOH/g, more preferably <15 mg KOH, most preferably <5 mg KOH, as measured using ASTM E28-18.

In another aspect, a method of preparing a metal surface for subsequent working of the metal to fabricate articles is prepared. The method comprising: diluting a MWF concentrate in water forming a metal-working fluid (MWF) as oil-in-water emulsion, for a water concentration of 80-99% based on the total weight of the MWF, and apply the oil-in-water emulsion as a substantially continuous layer onto the metal surface to deposit onto the metal surface an ultra-thin film of the metal working fluid. The DCR oil comprises 50 to 100 wt. % of tricyclic compounds having 18-20 carbon atoms, one or more C═C groups, and m/z (mass/charge) value of 220-280. The DCR comprises >50 wt. % of tricyclic and polycyclic compounds having 18-20 carbon atoms, <45 wt. % of tricyclic compounds as reactive double bond (C═C group), based on total weight of the DCR, and sum of amounts of tricyclic compounds as aromatics and cycloaliphatic is >55 wt. %, based on total weight of the DCR.

DESCRIPTION

The following terms will be used throughout the specification with the following meanings unless specified otherwise.

"At least one of [a group such as A, B, and C]" or "any of [a group such as A, B, and C]," or "selected from [A, B, and C], and combinations thereof" means a single member from the group, more than one member from the group, or a combination of members from the group. For example, at least one of A, B, and C includes, for example, A only, B only, or C only, as well as A and B, A and C, B and C; or A, B, and C, or any other all combinations of A, B, and C. In another example, at least one of A and B means A only, B only, as well as A and B.

A list of embodiments presented as "A, B, or C" is to be interpreted as including the embodiments, A only, B only, C only, "A or B," "A or C," "B or C," or "A, B, or C."

"Deionized water" (DI water, DIW or de-ionized water), or demineralized water (DM water), is water that has had almost all its mineral ions removed, such as cations like sodium, calcium, iron, and copper, and anions such as chloride and sulfate.

"Metal-working fluid" may be used interchangeably with MWF, or "metal-working composition," "metal removal fluid," "cutting fluid," "machining fluid," referring to a composition that can be used in industrial metal cutting, metal grinding operations or in the semiconductor industry wherein the shape of the final object, e.g., silicon wafer or machine part, is obtained by with or without the progressive removal of metal or silicon. Metal-working fluids amongst other functions, are used to cool and to lubricate.

"Soluble Oil" refers to a MWF which contain appreciable amounts of water and provided to the end-user as an oil-in-water emulsion containing specialty additives. The oil content of a Soluble Oil MWF concentrate ranges from 40-90%, with the oil content in the final MWF in application ranges from about 5-10 wt. %, and typically diluted with water at the user's site.

"Semi-synthetic Fluid" refers to a MWF concentrate containing 5-40 wt. % oil and are diluted in water at the user's site.

wt. % refers to weight concentration.

Density is measured per ASTM D792-13.

The disclosure relates to a biobased metal-working fluid ("MWF") composition and method for making same, and more particularly MWF with biobased base oils with improved emulsion stability. The biobased base oil is a plant-derived decarboxylated rosin acid ("DCR") liquid product.

Water Component: The metal-working fluid contains an aqueous phase which may be either deionized water (DI water), or hard water, or any combination thereof.

In embodiments and depending on the application, the amount of water in the final MWF (at the application site) ranges from 80-99%, or 85-92%, or >90%, or up to 95%, or up to 99% of the total weight of the final MWF.

Major Component—Decarboxylated Rosin Acid (DCR) as Base Oil: In embodiments, the MWF contains DCR as the only base oil component (100%), or >50 wt. %, or >60 wt. %, or >70 wt. % of the base oil component. DCR can be either a crude DCR, a distilled or purified DCR (>90% purity), or mixtures thereof. Crude DCR is almost similar in composition with the distilled DCR, with the heavy fraction (10-15%) being removed to improve color, reduce sulfur, etc.

DCR is produced by the decomposition of rosin acids at high temperatures. Rosin acids are normally solid, having a softening point of, e.g., 65-85° C. Rosin acid is non-petroleum and plant-derived from gum (from pine trees), wood (from tree stumps), and tall oil (by-product from the paper industry). The rosin acids can be fully or partially decarboxylated, forming decarboxylated rosin acid (DCR or DCR oil).

DCR is mixture of molecules, some of which contain monocarboxylic acids having a general molecular formula, e.g., $C_{20}H_{30}O_2$. In embodiments, DCR is characterized as containing 40-100 wt. % of tricyclic compounds and polycyclic having 18-20 carbon atoms, one or more C═C groups, and m/z (mass/charge) values in the range of 220-280, or 230-270, or 234-262, or 235-265, or >230, or <265 as measured by GC-FID-MS. m/z is defined as the molecular weight (MW) divided by the charge of the compound, which is ~1 for DCR.

In embodiments, sum of tricyclic compounds as aromatic and cycloaliphatic in the DCR is >50 wt. %, or >55 wt. %, or >60 wt. %, or >74 wt. %, or >90 wt. % of total weight of the DCR. Aromatic DCR is defined as DCR species having a MW of 252 or 256, and cycloaliphatic DCR is defined as DCR species having a MW of 260 or 262.

In embodiments, the amount of cycloaliphatic DCR is >30 wt. %, or >40 wt. %, or >50 wt. %, or >80 wt. %, based on the total weight of the DCR.

In embodiments, total amount of tricyclic compounds as reactive double bond (C═C group) is <45 wt. %, or <40 wt. %, or <30 wt. %, or <10 wt. % of total weight of the DCR. Reactive C═C group is defined as DCR species having a MW of 254 and 258.

In embodiments, the DCR is characterized as having an oxygen content of <5%, or <3%, or <2%, or 0-1%. Oxygen content (in %) in the DCR is calculated as the oxygen to carbon ratio, or the sum of oxygen atoms present divided by sum of carbon atoms present, with the number of oxygen and carbon atoms being obtained from elemental analyses.

In embodiments, the DCR has a density of 0.9-1.0 g/cm$^3$, 0.91-0.99 g/cm$^3$, or 0.92-0.98 g/cm$^3$, or 0.93-0.97 g/cm$^3$, or 0.94-0.96 g/cm$^3$, >0.9 g/cm$^3$, or <1.1 g/cm$^3$ at 20° C.

The DCR has a low acid value (carboxylic acid content) than the rosin acid. In embodiments, the DCR has the acid value of <50 mg KOH/g, or <45 mg KOH/g, or <40 mg KOH/g, or <35 mg KOH/g, or <30 mg KOH/g, or <25 mg KOH/g, or <20 mg KOH/g, or <15 mg KOH/g, or <5 mg KOH/g, or 2-30 mg KOH/g, or 4-25 mg KOH/g, or 5-20 mg KOH/g, as measured using ASTM E28-18.

In embodiments, the DCR has an aromatic content of 30-60 wt. %, or 32-56 wt. %, or 35-54 wt. %, or 38-52 wt. %, or 40-50 wt. %, or >30 wt. %, or <45 wt. %, based on the total weight of the DCR, according to ASTM D2140.

In embodiments, the DCR has a naphthenic content of 40-60 wt. %, 42-58 wt. %, or 45-55 wt. %, or 42-52 wt. %, or >45 wt. %, or <55 wt. %, based on the total weight of the DCR, according to ASTM D2140.

In embodiments, the DCR has a paraffinic content of 20-35 wt. %, or 22-34 wt. %, or 24-32 wt. %, or 26-30 wt. %, or >22 wt. %, or <32 wt. %, based on the total weight of the DCR, according to ASTM D2140.

In embodiments, the DCR is characterized as having viscosities comparable to those of petrochemical base oils, due in part to its relatively high molecular weights, for example, a viscosity of 20-50 cSt, or 22-48 cSt, or 25-45 cSt, or 28-42 cSt, or 30-40 cSt, or >28 cSt, or <45 cSt, according to ASTM D-445, measured at 40° C.

In embodiments, the DCR has an aniline point of 5-40° C., or 10-25° C., or 13-29° C., or <25° C., or >8° C., according to ASTM D611.

In embodiments, the DCR has a pour point of −30 to +10° C., −28 to +8° C., or −25 to +5° C., or >−25° C., or <+5° C., according to ASTM D97.

In embodiments, the DCR has a flash point of 140-160° C., or 142-158° C., or 144-156° C., or 146-154° C., or >146° C., or <154° C., or <160° C., according to ASTM D92.

In embodiments, the DCR has a boiling point of 235-390° C., or >230° C., or <400° C., measured according to D2887.

In embodiments, the DCR has a Gardner Color of 1.0-3.0, or 1.1-2.9, or 1.2-2.8, or 1.3-2.7, or 1.4-2.6, or 1.5-2.5, >1.2, or <2.4, or <3.0, according to ASTM D6166.

In embodiments, the DCR has a sulfur content of <0.05 wt. %, or <0.04 wt. %, or <0.03 wt. %, or <0.02 wt. %, or <0.01 wt. %, or <0.001 wt. %, or 40-200 ppm, or <500 ppm, or <100 ppm, based on total weight of the DCR, measured according to ASTM D5453.

In embodiments, the DCR has a VOC of <5 wt. %, or <4.75 wt. %, or <4.5 wt. %, or <4.25 wt. %, or <4.0 wt. %, or <3.75 wt. %, <3.5 wt. %, <3.25 wt. %, <3.0 wt. %, <2.75 wt. %, or <2.5 wt. %, <2.25 wt. %, <2.0 wt. %, or <1.5 wt. %, <1.0 wt. %, or <0.5 wt. %, based on total weight of the DCR. The VOC of the DCR is measured according to the EPA (Environmental Protection Agency) method 24 or equivalent, by summing the % by weight contribution from all VOCs present in the product at 0.01% or more.

In embodiments of Semi-synthetic Fluid MWF, the DCR oil amount ranges from 5-40 wt. %, or >5 wt. %, or >30 wt. %, or >35 wt. %, or <45 wt. % of the total weight of the MWF concentrate.

In embodiments for Soluble Oil MWF, the amount of DCR ranges from 40-90 wt. %, or >55% wt. %, or >60 wt. %, or >65 wt. %, or <85 wt. % of the total weight of the MWF concentrate.

Optional Base Oil Component: In some embodiments, a small amount of a (different) oil can be used in addition to the DCR as the base oil component.

In embodiments, the additional base oil is selected from Group I and/or Group II base oils, e.g., paraffin base crude oil, middle crude oil, or naphthenic base crude oil; vegetable oils (e.g., soybean oil, etc.), short and branched chain esters derived from fats and oils (e.g., methyl ester for soybean, isopropyl oleate, trimethylolpropane oleate, etc.), and refined oils obtained by refining these distillates.

The amount of an additional base oil (other than the DCR), if used, is less than 50% of the total amount of base oil. In embodiments of Semisynthetic Fluid, the amount of additional base oil used ranges from 2 to 25%, or <20%, or <10% of the total weight of the MWF. In embodiments for Soluble Oil, the amount of additional base oil, if used, ranges from 20-45 wt. %, or <40%, or <30%, or <20% of the total weight of the MWF concentrate.

In embodiments, the additional base oil component is Group I base oil, at a weight ratio of DCR:Group I base oil ranging from 50:50 to 90:10 (as total weight of base oil).

Emulsifier Component: The MWF further comprises at least an emulsifier, and preferably two or more emulsifiers (e.g., an emulsifier and a co-emulsifier), which can be the same or different types. Choices of emulsifiers depend on the amount of water, the amount and type of the oil component used. Emulsifiers are selected from any of the conventional anionic, cationic, nonionic, or amphoteric surfactants.

In embodiments, the emulsifier component is selected from amphoteric compounds. Examples include alkyl-3-iminodipropionate; alkyl-3-amino-propionate; fatty imidazolines and betaines, more specifically 1coco-5-hydroxyethyl-5-carboxymethyl imidazoline; dodecyl-3-alanine; N-dodecyl-N, N-dimethyl amino acetic acid; 2-trimethyl amino lauric acid inner salts; and the like.

In embodiments, the emulsifier component is selected from nonionic surfactants such as ethylene oxide adducts of alcohols, polyols, phenols, carboxylic acids, and carboxylic acid esters such as ethylene oxide adducts of oleyl alcohol, nonyl phenol, glycerol, sorbitol, mannitol, pentaerythritol, sorbitan monolaurate, glycerol monooleate, pentaerythritol monostearate, oleic acid, stearic acid, and the like.

In embodiments, the emulsifier component is selected from cationic compounds include cetyl pyridinium bromide, hexadecyl morpholinium chloride, dilauryl triethylene tetramine diacetate, didodecylamine lactate, 1-amino-2-heptadecenyl imidazoline acetate, cetyl amine acetate, oleylamine acetate, ethoxylated tallow, coco, stearyl, oleyl or soya amine, and the like. Useful anionic compounds include alkali metal salts of petroleum sulfonic acids, alkali metal salts of fatty acids, amine and ammonium soaps of fatty acids, alkali metal dialkyl sulfosuccinates, sulfated oils, sulfonated oils, alkali metal alkyl sulfates, and the like.

In embodiments, the emulsifiers are oil-soluble emulsifiers such as such as organic sulfonates, esters of fatty acids, polyoxyethylene acids, alcohols and alkanolamides, and alkanolamines, the latter generally being preferred. Examples include monoethanolamine, diethanolamine, triethanolamine, or isopropanolamine.

In embodiments, an emulsifier which is 50-100% soluble in water is used, e.g., a rosin acid ester. In an embodiment, a distilled tall oil (DTO) or a tall oil fatty acid (TOFA) is used and the main emulsifier, or a co-emulsifier in conjunction with another emulsifier (e.g., a sulfonate).

The amount of emulsifier ranges from 0.1 to 15%, or 0.3% to 12%, or at least 10% of the total weight of the MWF concentrate.

Optional Components: The metal working fluid optionally comprises one or more components selected from saponifiers or (pH) buffers, preservatives, extreme pressure (EP) additives or anti-wear additives, corrosion inhibitors, anti-wear agents, metal deactivators, defoamers, anti-rust agents, deodorants, dyes, fungicides, bacteriocides, antioxidants, emulsion or dispersion stabilizers and the like, deodorants, dyes, fungicides, bacteriocides.

Examples of saponifiers/buffers include alkanolamines, e.g., primary, secondary and tertiary, aminomethylpropanol (AMP-95), diglycolamine (DGA), monoethanolamine (MEA), monoisopropanolamine (MIPA), butylethanolamine (NBEA), dicylclohexylamine (DCHA), diethanolamine (DEA), butyldiethanolamine (NBDEA), triethanolamine (TEA), metal alkali hydroxides, potassium hydroxide, sodium hydroxide, magnesium hydroxide, lithium hydroxide, metal carbonates and bicarbonates, sodium carbonate, sodium bicarbonate, potassium carbonate and potassium bicarbonatetriethanolamine and ethylenediaminetetraacetic acid.

Examples of corrosion inhibitors include but are not limited to organic amines, metallic salts of organic sulfonates, petroleum oxidates, organic diamines, organic amine condensates of fatty alcohols, and substituted imidazolines.

Examples of anti-wear additives (AW, lubricity improvers) include organic acids. Examples of such organic acids include caprylic acid, pelargonic acid, isononanoic acid, capric acid, lauric acid, stearic acid, oleic acid, benzoic acid, p-tert-butylbenzoic acid, adipic acid, suberic acid, sebacic acid, azelaic acid, and dodecandioic acid.

In embodiments, the MWF includes at least an extreme pressure (EP)/coupling agent selected from zinc dithiophosphate (ZDP), zinc dialkyl dithio phosphate (ZDDP), tricresyl phosphate (TCP), Halocarbons (chlorinated paraffins), Glycerol mono oleate, Stearic acid, nonionic surfactant include ethers such as polyoxyethylene alkyl ether and polyoxyethylene alkylphenyl ether; esters such as sorbitan fatty acid ester, polyoxyethylene sorbitan fatty acid ester, and polyoxyethylene fatty acid ester; and conventional coupling agents such as volatile alcohols such as sec-butanol, butyl oxitol or cyclohexanol.

In embodiments, depending on the optional additives, the amount ranges from 0.1 to 15 wt. %, or <10 wt. %, or >0.5 wt. %, or <5 wt. %, or <2 wt. % of the total weight of the MWF concentrate.

Method for Making/Applications: Depending on the base oil employed (100% DCR, or a mix of DCR and at least a different base oil), the components can be mixed at the same time, or in certain sequences, forming a concentrate. In embodiments, additives such as corrosion inhibitors and emulsifiers are first missed, prior to the addition of additives such as the saponifier, and then the buffer.

In use, the MWF is subsequently produced by dispersing the concentrate with water, e.g., using a high shear mixer for use metal machining processes such as cutting, grinding, punching, polishing, deep drawing, drawing, and rolling, providing excellent lubricity for machining a so-called hard-to-work material.

Properties: Metal-working fluids prepared from the concentrate with DCR (or a mix with DCR and a different base oil) as a base oil component is characterized as providing same or better performance compared to MWF prepared solely from mineral oils, e.g., Group I or Group II oil.

In embodiments with a base oil component containing at least 50% DCR (based on the amount of DCR in total amount of base oil component), the MWF as prepared shows excellent stability, even after 28 days at 60° C. In high frequency reciprocating rig (HFRR) tests, the MWF showed comparable film thickness and friction coefficient versus the corresponding MWF with naphthenic oil water in oil emulsion. The oil-in-water MWF fluid also shows minimal foam formation, of less than 50 mm per foam test (as explained below).

Examples: The Following Tests were Conducted on the Samples in the Examples

Lubricity test HFRR (high frequency reciprocating rig): Per ASTM D6079, reporting average 63% film thickness and 0.104 coefficient of friction. This is done by measuring the electrical resistance between two mating objects. It is zero percent film at no resistance and 100% at high resistance.

Stability testing: Each sample is tested for initial stability of both concentrate and emulsion, centrifuge stability and long-term stability at 60° C. Centrifuge stability is carried out after 30 minutes at 3000 rpm and observed for separation.

Foaming tendency: Foam test involved shaking 100 mL of the emulsion in a 250 mL graduated cylinder for 1 minute, then measuring initial foam height and foam height after 1 minute of standing.

Particle Size: Particle size was measured using Beckman Coulter Delsa Nanoparticle analyzer.

Iron chip corrosion: Evaluation was carried out per ASTM 4267.

DCR: A DCR from Kraton Corporation having the properties as shown in Table 1 was used for the examples.

TABLE 1

| Property | Method | Properties |
|---|---|---|
| Viscosity, cSt @ 40° C. | ASTM D445 | 32.4 cSt |
| Density at 20° C. | ASTMD1480 | 0.96 g/cm$^3$ |
| Viscosity Index | — | −179 |
| Color | ASTM D6166 | 2 Gardner |
| Flash Point, COC | ASTM D92 | 158° C. |
| Pour Point | ASTM D97 | −24° C. |
| Boiling Point | ASTM D2887 | 300-360° C. |
| Aniline Point | ASTM D611 | 15° C. |
| Sulfur | ASTM D5453 | <0.01% |
| Boiling Point Range | ASTM D2887 | 300-360° C. |
| Acid # (carboxylic acid) | ASTM D465 | 5-7 mg KOH/g |
| Aromatic Content (%) | ASTM D2140 | 32 |
| Naphthenic Content (%) | ASTM D2140 | 46 |
| Paraffinic Content (%) | ASTM D2140 | 22 |
| Kinematic viscosity 40° C. | ASTM D445 | 32.4 cSt |
| Paraffinic Content (%) | ASTM D2140 | 22 |

Rosin oils: Rosin oils were prepared by experimental procedure known in the art as shown below for comparative examples. The nomenclature xx as in "AN-26," "AN-80," etc., refers to the acid number of the (crude) rosin oil sample. PTSA refers to p-toluene sulfonic acid, and PTSA/S refers to experiments with PTSA with the inclusion of sulfur.

Rosin oil AN-10 (PTSA/S): Rosin acid was heated to 180° C., in a round bottom flask and then 3.75 wt. % sulfur was charged. The temperature was increased and remained at 230° C. after sulfur charge. After 4 hrs. reaction mixture was charged with 2 wt. % of PTSA and the temperature increased to 290° C. The reaction mixture was kept at 290° C. for 51 hours until the acid number of 10 mg KOH/g was obtained.

Rosin oil AN-80 (PTSA/S): AN 80 was obtained in the same manner as AN-10, except that the reaction mixture was held at 290° C. for 1 hour for an acid number of 80 mg KOH/g.

Rosin Oil AN-80 (Thermal): The experiment was without any catalyst, e.g., PTSA/S. Rosin acid was heated to 320° C. at 40° C./hr. and reaction was held at 320° C. for 75 hours until reaching 80 mg KOH/g.

Other Rosin Oils: The above experiments were repeated but with different reaction time periods for rosin oil samples with different acid numbers, e.g., AN-23 (PTSA/S), AN-26 (PTSA/S), AN-37 (Thermal), and with a different catalyst (hydrophosphorous) for AN-6. These comparable rosin oils are used in Examples 5A-5E.

Distillate Examples: Some of the prior art rosin oil samples and DCR samples were refined to obtained distillate samples. Properties of the crude DCR are below in Table 2A, and properties of the distilled DCR are shown in Table 2B below.

TABLE 2A

Properties of crude products (rosin oils and DCR)

| | Crude AN-80 (Thermal) | Crude AN-80 (PTSA/S) | Crude AN-10 (PTSA/S) | Crude DCR AN-71 | Crude DCR AN-7 |
|---|---|---|---|---|---|
| Acid Number mg KOH/g | 80 | 80 | 10 | 71 | 7 |
| Viscosity, 'cSt @ 40 C. | — | — | 211.5 | 46.7 | 25.2 |
| Density, 40 C. | — | — | 0.98 | 0.95 | 0.95 |
| % O2 content | 4.5 | 4.5 | 0.57 | 4 | 0.39 |
| Tricyclic Compounds, % | 72.3 | 74.6 | 71.5 | 88.2 | 69.5 |
| MW 238 | 5.4 | 2.1 | 17.5 | 0.0 | 0.0 |
| MW 252 - aromatic | 0.4 | 2.1 | 5.3 | 5.7 | 15.7 |
| MW 254 - reactive double bond | 2.7 | 28.0 | 25.0 | 3.1 | 0.1 |
| MW 256 - aromatic | 9.6 | 7.8 | 19.8 | 20.1 | 40.3 |
| MW 258 - reactive double bond | 4.7 | 1.5 | 1.2 | 0.1 | 0.4 |
| MW 260 - cycloaliphatic | 3.1 | 4.0 | 2.4 | 25.6 | 0.7 |
| Mono-unsat. Abietic acids | 5.4 | 0.6 | 0.0 | 0.0 | 0.0 |
| Dehydroabietic acid | 32.3 | 29.1 | 3.9 | 33.8 | 0.0 |
| Unidentified | 3.3 | 5.8 | 4.2 | 4.2 | 6.9 |
| Thermal trimer | 19.6 | 12.5 | 17.7 | 1.1 | 7.1 |
| other | 4.4 | 5.5 | 1.2 | 3.4 | 3.1 |
| TOTAL | 100.0 | 100.0 | 100.0 | 100.0 | 98.9 |

TABLE 2B

Properties of distillate products prepared from rosin oils and DCR

| | Distillate AN-80 (Thermal) | Distillate AN-80 (PTSA/S) | Distillate AN-10 (PTSA/S) | Distillate DCR AN-71 | Distillate DCR AN-7 |
|---|---|---|---|---|---|
| Acid Number mg KOH/g (after distillation) | 42 | 23 | — | 51 | 2 |
| Color | 4.1 | 5.9 | 5.5 | 2.7 | 1 |
| Viscosity, 'cSt @ 40 C. | 105.2 | NA | 20.9 | 142 | 45.3 |
| Density, 40° C. | 0.93 | NA | 0.95 | 0.91 | 0.95 |
| % $O_2$ content | 2.4 | 1.3 | 1.7 | 2.9 | 0.1 |
| Tricyclic Compounds | 49.4 | 86 | 68.7 | 74 | 77.7 |
| MW 238 | 8.9 | 4.0 | 20.0 | 0.0 | 0.0 |
| MW 242 | 20.8 | 0.0 | 0.0 | 0.0 | 0.0 |
| MW 252 - aromatic | 0.8 | 4.5 | 9.1 | 5.9 | 14.0 |
| MW 254 - reactive C═C | 10.5 | 56.0 | 23.5 | 4.4 | 0.5 |
| MW 256 aromatic | 24.5 | 10.5 | 32.1 | 29.5 | 45.3 |
| MW 258 - reactive C═C | 9.0 | 2.9 | 0.2 | 0.1 | 0.8 |
| MW 260 - cycloaliphatic | 5.4 | 8.4 | 3.0 | 30.6 | 0.3 |
| MW 262 - cycloaliphatic | 0.0 | 0.0 | 0.0 | 0.0 | 18.4 |
| Dehydroabietic acid | 8.6 | 6.5 | 1.3 | 18.8 | 0.0 |

Examples 1A-1F Soluble Oil MWF in DI Water: MWF formulations were produced from different concentrates with components according to Table 3, with different base oil replacing the naphthenic base oil in Table 3. MWF formulations were made by dispersing 56 grams of each concentrate into 644 grams of DI (deionized) water for each example. The differences in the examples being the base oil component(s) and proportions as indicated in Table 4, with some examples having DCR (with acid number of ~7 mg KOH/g) and mineral oil base components. Table 4 also shows with results of the tests for stability, particle size, foaming tendency, lubricity, and corrosion.

TABLE 3

Soluble Oil Concentrate

| Concentrate Component | Amount (g) | Weight % |
|---|---|---|
| Naphthenic base oil 100 SUS | 50.65 | 77.93 |
| Synthetic sodium sulfonate MW 470 | 1.21 | 1.86 |
| Distilled tall oil | 6.91 | 10.64 |
| Triethanolamine | 1.73 | 2.66 |
| Polyoxyl castor oil surfactant | 4.49 | 6.91 |
| Total | 65.00 | 100.00 |

TABLE 4

Soluble Oil Formulations - DI Water

| Performance Parameter | Example 1A | Example IB | Example 1C | Example ID | Example IE | Example IF |
|---|---|---|---|---|---|---|
| Base Oil Selection | Group I | DCR | DCR /Group I (50/50) | Group II | DCR /Group II (10/90) | DCR /Group II (50/50) |
| Concentrate stability | Stable | Stable | Stable | Not stable | Not stable | Stable |
| Emulsion stability, centrifuge | Stable | Stable | Stable | Not stable | Not stable | Stable |
| Emulsion stability, 60 C. | Stable 28 days | Stable 28 days | Stable 28 days | Not measured | Not measured | Stable 28 days |
| Cumulants particle size, nm | 217 | 197 | 186 | Not measured | Not measured | 247 |
| HFRR, % film/friction coefficient | 94/0.088 | 88/0.093 | 88/0.094 | Not measured | Not measured | 97/0.072 |
| Foam, mm, initial/1 minute | <5/<5 | <5/<5 | <5/<5 | Not measured | Not measured | 5/<5 |
| Corrosion, % rust on paper | 0 | 0 | 0 | Not measured | Not measured | 0 |

Examples 2A-2F—Semi-Synthetic MWF in DI Water: MWF formulations were produced from concentrates with the components according to Table 5, with different base oil as the replacement. MWF formulations were made by dispersing 30 grams of the concentrate into 345 grams of DI (deionized) water for each example. As with the above examples, the differences in the examples being the base oil component(s) and proportions as indicated in Table 6, with some examples having DCR (with acid number of ~7 mg KOH/g) and mineral oil base components. Table 6 also shows with results of the tests for stability, particle size, foaming tendency, lubricity, and corrosion.

TABLE 5

Semi-Synthetic Concentrate

| Concentrate Component | Amount | Weight % |
|---|---|---|
| Base oil | 25.33 | 63.85 |
| Synthetic sodium sulfonate MW 470 | 1.21 | 3.05 |
| Distilled tall oil | 6.91 | 17.42 |
| Triethanolamine | 1.73 | 4.36 |
| Polyoxyl castor oil surfactant | 4.49 | 11.32 |
| Total | 39.67 | 100.00 |

TABLE 6

Synthetic Oil Formulations - DI Water

| Performance Parameters | Example 2A | Example 2B | Example 2C | Example 2D | Example 2E | Example 2F |
|---|---|---|---|---|---|---|
| Base Oil | Group I | DCR | DCR/ Group I 50/50) | Group II | DCR/ Group II (10/90) | DCR/ Group II (50/50) |
| Concentrate stability | Stable | Stable | Stable | Not stable | Not stable | Stable |
| Emulsion stability, centrifuge | Stable | Stable | Stable | Not stable | Not stable | Stable |
| Emulsion stability, 60 C. | 28 days | 28 days | 28 days | Not measured | Not measured | 28 days |
| Cumulants particle size, nm | 143 | 101 | 91 | Not measured | Not measured | 153 |
| HFRR, % film/friction coefficient | 82/0.102 | 79/0.102 | 74/0.104 | Not measured | Not measured | 90/0.099 |
| Foam, mm, initial/1 minute | 50/<5 | 50/<5 | 50/<5 | Not measured | Not measured | 50/<5 |
| Corrosion, % rust on paper | 0 | 0 | 0 | Not measured | Not measured | 0 |

Examples 3A-3F Soluble Oil MWF in Hard Water: Examples 1A-1F with soluble oil concentrate formulations were repeated, but the concentrates were dispersed in hard water (500 ppm of calcium chloride in DI water), instead of just DI. Table 7 shows test results for stability, particle size, foaming tendency, lubricity, and corrosion.

TABLE 7

Soluble Oil Formulations, Hard Water

| Performance Parameter | Example 3A | Example 3B | Example 3C | Example 3D | Example 3E | Example 3F |
|---|---|---|---|---|---|---|
| Base Oil | Group I | DCR | DCR/ Group I (50/50) | Group II | DCR/Group II (10/90) | DCR/ Group II (50/50) |
| Concentrate stability | Stable | Stable | Stable | Not stable | Not stable | Stable |
| Emulsion stability, centrifuge | Stable | Stable | Stable | Not stable | Not stable | Stable |
| Emulsion stability, 60 C./% separation | >21 <28 days/<1% | >14 <21 days/<1% | >14 <21 days/< 1% | Not measured | Not measured | >1 <7 days/5% |
| Cumulants particle size, nm | 176 | 175 | 191 | Not measured | Not measured | 300 |
| HFRR, % film/friction coefficient | 94/0.078 | 98/0.086 | 94/0.080 | Not measured | Not measured | 98/0.080 |
| Foam, mm, initial/1 minute | Nil | Nil | Nil | Not measured | Not measured | Nil |
| Corrosion, % rust on paper | 0 | 0 | 0 | Not measured | Not measured | 0 |

Examples 4A-4B: MWF formulations were produced from different concentrates with components according to Table 3, with different rosin oils replacing the naphthenic base oil in Table 3. MWF formulations were made by dispersing 56 grams of each concentrate into 644 grams of hard water for each example. Table 8 shows with results of the tests for stability, particle size, foaming tendency, lubricity, and corrosion.

TABLE 8

Soluble Oil Formulations - Comparative Rosin oils, in Hard Water

| Performance Parameter | Example 4A | Example 4B |
|---|---|---|
| Base Oil | AN-7 | AN-71 |
| Concentrate stability | Not separated | Separated |
| Emulsion stability, centrifuge | Not stable | Not stable |
| Emulsion stability, 60 C./% separation | Not measured | Not measured |

TABLE 8-continued

Soluble Oil Formulations - Comparative Rosin oils, in Hard Water

| Performance Parameter | Example 4A | Example 4B |
|---|---|---|
| Cumulants particle size, nm | Not measured | Not measured |
| HFRR, % film/friction | Not measured | Not measured |
| Foam, mm, initial/1 minute | Not measured | Not measured |
| Corrosion, % rust on paper | Not measured | Not measured |

Examples 5A-5E: MWF formulations were produced from different concentrates with components according to Table 3, with different rosin oil and distillates replacing the naphthenic base oil in Table 3. MWF formulations were made by dispersing 56 grams of each concentrate into 644 grams of hard water for each example. Table 9 shows results of the tests for stability, particle size, foaming tendency, lubricity, and corrosion.

TABLE 9

Soluble Oil Formulations Comparative Rosin Oils-Distillates

| Performance Parameter | Example 5A | Example 5B | Example 5C | Example 5D | Example 5E |
|---|---|---|---|---|---|
| Base Oil | AN-23 PTSA/S | AN-26 PTSA/S | AN-37 Thermal | AN-10 Thermal | AN-6 Hydro-phosphorous |
| Concentrate stability | clear | clear | clear | clear | clear |
| Emulsion Stability, Initial | stable | stable | stable | stable | stable |
| Emulsion stability, centrifuge | stable | stable | stable | stable | stable |
| Emulsion stability, 60 C./% separation | Stable >1 <7 days | Stable >1 <7 days | Stable >1 <7 days | Stable >1 <7 days | Stable >1 <7 days |
| pH initial | 7.2 | 7.6 | 7.4 | 7.6 | 7.6 |
| pH after stability | — | — | — | — | — |
| Cumulants particle size, nm | 153 | 195 | 153 | 130 | 180 |
| HFRR, % film/friction coefficient | 97/0.099 | 78/0.099 | 99/0.096 | 97/0.101 | 96/0.092 |
| Foam, mm, initial/1 minute | 0/0 | 0/0 | 20/0 (almost immediately) | 10/0 (almost immediately) | 0/0 |
| Corrosion, % rust on paper | — | — | — | — | — |

Examples 6A-6E: MWF formulations were produced from different concentrates with components according to Table 3, with olive oil, methyl oleate and isopropyl oleate replacing the naphthenic base oil in Table 3, with 56 grams of each concentrate into 644 grams of hard water. Table 10 shows with results of the tests for stability, particle size, foaming tendency, lubricity, and corrosion.

TABLE 10

Soluble Oil Formulations, Hard water.

| Performance Parameter | Example 6A | Example 6B | Example 6C | Example 6D | Example 6E |
|---|---|---|---|---|---|
| Base Oil | Olive oil | Olive oil:DCR 1:1 | Methyl Oleate | Methyl Oleate:Crude DCR 1:1 | Isopropyl Oleate |
| Concentrate stability | Separated | Slight haze | Clear | Clear | Clear |

TABLE 10-continued

| Soluble Oil Formulations, Hard water. | | | | | |
|---|---|---|---|---|---|
| Performance Parameter | Example 6A | Example 6B | Example 6C | Example 6D | Example 6E |
| Emulsion Stability, Initial | Not stable, separated within 1 hour | Not stable, separated within 1 hour | Stable | Stable | Stable |
| Emulsion stability, centrifuge | Not stable | Not stable | Stable | Stable | Stable |
| Emulsion stability, 60 C./% separation | Not measured | Not measured | Separated <21 days | Separated <21 days | Separated <21 days |
| pH initial | Not measured | Not measured | 7.8 | 7.9 | 7.6 |
| pH after stability | Not measured | Not measured | TBD | TBD | TBD |
| Cumulants particle size, nm | 1083 | 308 | 182 | 200 | 179 |
| HFRR, % film/ friction coefficient | Not measured | Not measured | 93/0.087 | 87/0.081 | 94/0.069 |
| Foam, mm, initial/ 1 minute | Not measured | Not measured | 0/0 | 0/0 | <5/0 |
| Corrosion, % rust on paper | Not measured | Not measured | 0 | 5 | 0 |

Examples 7A-7F Semi-Synthetic MWF in Hard Water: Examples 2A-2F with semi-synthetic concentrate formulations were repeated, but the concentrates were dispersed in hard water (500 ppm of calcium chloride in DI water), instead of just DI. Table 11 shows test results for stability, particle size, foaming tendency, lubricity, and corrosion.

TABLE 11

| Semi-Synthetic Formulations, Hard Water | | | | | | |
|---|---|---|---|---|---|---|
| Performance Parameter | Example 7A | Example 7B | Example 7C | Example 7D | Example 7E | Example 7F |
| Concentrate stability | Stable | Stable | Stable | Not stable | Not stable | Stable |
| Emulsion stability, centrifuge | Stable | Stable | Stable | Not stable | Not stable | Stable |
| Emulsion stability, 60C/% separation | 28 days | >14 <21 days/<1% | 28 days | Not measured | Not measured | >14 <21 days/<1% |
| Cumulants particle size, nm | 119 | 142 | 152 | Not measured | Not measured | 217 |
| HFRR, % film/friction coefficient | 93/0.086 | 86/0.097 | 93/0.096 | Not measured | Not measured | 97/0.078 |
| Foam, mm, initial/1 minute | 20/<5 | 20/<5 | 20/<5 | Not measured | Not measured | 20/<5 |
| Corrosion, % rust on paper | 0 | 0 | 0 | Not measured | Not measured | 0 |

As illustrated, DCR can be substituted for all or part of mineral oils, e.g., Group I or Group II. A Group II oil which does not produce a stable product when used in the same formulation can be supplemented with 50% DCR to produce a stable product. Substituting 50% of the naphthenic oil to the paraffinic oil does not provide the same remediation. Although there are some differences seen when formulating with hard water versus DI water, the variations between the traditional oils and DCR are minimal, mainly as regards long term stability at 60° C.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the terms "include" or "contain" and their grammatical variants are intended to be non-limiting, such that recitation of items in a list is not to the exclusion of other like items that can be substituted or added to the listed items.

As used herein, the term "comprising" means including elements or steps that are identified following that term, but any such elements or steps are not exhaustive, and an embodiment can include other elements or steps. As used herein, the term "comprising" means including elements or steps that are identified following that term, but any such elements or steps are not exhaustive, and an embodiment can include other elements or steps. Although the terms "comprising" and "including" have been used herein to describe various aspects, the terms "consisting essentially of" and "consisting of" can be used in place of "comprising" and "including" to provide for more specific aspects of the disclosure and are also disclosed.

Unless otherwise specified, the recitation of a genus of elements, materials, or other components, from which an individual component or mixture of components can be selected, is intended to include all possible sub-generic combinations of the listed components and mixtures thereof.

The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

The invention claimed is:

1. A metal-working fluid concentrate for use as an oil-in-water emulsion, comprising:

a base oil component in an amount of 5-90 wt. %, based on the total weight of the concentrate;

an emulsifier selected from any of the conventional anionic, cationic, nonionic, or amphoteric surfactants, in an amount of 0.1 to 15 wt. %;

at least an optional additive selected from saponifiers, pH buffers, preservatives, extreme pressure EP additives, corrosion inhibitors, anti-wear agents, metal deactivators, defoamers, anti-rust agents, deodorants, dyes, fungicides, bacteriocides, antioxidants, emulsion stabilizers, dispersion stabilizers in an amount of 0.1 to 15 wt. %;

wherein the base oil component contains at least 50% by weight of a decarboxylated rosin acid (DCR) based on the total weight of the base oil component, and remainder being oil selected from naphthenic, paraffin, bio-based oil, and mixtures thereof, and wherein the DCR has:

a m/z (mass/charge) of 220-280 as measured by GC-FID-MS, an oxygen content of <5%, an acid value of <10 mg KOH/g; and wherein the DCR comprises:

>50% by weight as tricyclic and polycyclic compounds having 18-20 carbon atoms,

>55% by weight of tricyclic compounds as aromatic and cycloaliphatic,

<45% by weight of tricyclic compounds as reactive double bond (C=C group).

2. The metal-working fluid concentrate of claim 1, wherein the DCR has >25 wt. % aromatic content, >40 wt. % naphthenic content, and >15 wt. % paraffinic content, all based on total weight of the DCR.

3. The metal-working fluid concentrate of claim 1, wherein the DCR has at least one of:

a Brookfield viscosity of >20 cSt at 40° C.;

an aniline point of at least 5° C.;

a pour point of less than 30° C.;

a sulfur content of <0.05 wt. %;

a Gardner color of <3; and a flash point of <160° C.

4. The metal-working fluid concentrate of claim 1, wherein the DCR comprises >30% by weight of tricyclic compounds as cycloaliphatic.

5. The metal working fluid concentrate of claim 1, wherein the DCR comprises >60% by weight of tricyclic compounds as aromatics and cycloaliphatic.

6. The metal working fluid concentrate of claim 1, wherein the DCR comprises <30% by weight of tricyclic compounds as reactive double bond.

7. The metal-working fluid concentrate of claim 6, wherein the DCR comprises <10% by weight of tricyclic compounds as reactive double bond.

8. The metal working fluid concentrate of claim 1, wherein the DCR has 30-60% wt. % aromatic content; >40 wt. % naphthenic content, and 20-35 wt. % paraffinic content, all based on total weight of the DCR.

9. The metal working fluid concentrate of claim 1, wherein the concentrate is a Soluble Oil concentrate, and wherein the amount of the base oil component is 40-90 wt. % based on the total weight of the concentrate.

10. The metal-working fluid concentrate of claim 1, wherein the concentrate is a Semi-synthetic Fluid concentrate, and wherein the amount of the base oil component is 5-40 wt. % based on the total weight of the concentrate.

11. The metal-working fluid concentrate of claim 1, wherein the base oil component contains >50 wt. % DCR based on the total weight of the base oil component, and remainder is a Group I base oil.

12. The metal-working fluid concentrate of claim 1, wherein the base oil component contains DCR and a Group I base oil in a weight of ratio ranging from 50:50 to 90:10.

13. A method of preparing a metal surface for subsequent working of the metal to fabricate articles therefrom, the method comprising:

diluting the MWF concentrate of claim 1 in water forming a metal-working fluid (MWF) as oil-in-water emulsion, for a water concentration of 80-99% based on the total weight of the MWF;

apply the oil-in-water emulsion as a substantially continuous layer onto the metal surface to deposit onto the metal surface an ultra-thin film of the metal working fluid.

14. A method of preparing a metal surface for subsequent working of the metal to fabricate articles therefrom, the method comprising:

providing a metal-working fluid (MWF) concentrate comprising:

a base oil component in an amount of 5-90 wt. %, based on the total weight of the concentrate;

an emulsifier selected from any of the conventional anionic, cationic, nonionic, or amphoteric surfactants, in an amount of 0.1 to 15 wt. %;

at least an optional additive selected from saponifiers, pH buffers, preservatives, extreme pressure EP additives, corrosion inhibitors, anti-wear agents, metal deactivators, defoamers, anti-rust agents, deodorants, dyes, fungicides, bacteriocides, antioxidants, emulsion stabilizers, dispersion stabilizers in an amount of 0.1 to 15 wt. %;

wherein the base oil component contains at least 50% by weight of a decarboxylated rosin acid (DCR) based on the total weight of the base oil component, and remainder being an oil selected from naphthenic, paraffin, bio-based oil, and mixtures thereof, and wherein the DCR has:

a m/z (mass/charge) of 220-280 as measured by GC-FID-MS, an oxygen content of <5%, an acid value of <10 mg KOH/g; and wherein the DCR comprises:

>50% by weight as tricyclic and polycyclic compounds having 18-20 carbon atoms,

>55% by weight of tricyclic compounds as aromatic and cycloaliphatic,

<45% by weight of tricyclic compounds as reactive double bond (C=C group).

15. The method of claim 14, wherein the amount of tricyclic compounds as cycloaliphatic in the DCR is >30 wt. %.

16. The method of claim 14, wherein the amount of tricyclic compounds as reactive double bond in the DCR is <30 wt. %.

17. The method of claim 14, wherein the DCR has at least one of:

a Brookfield viscosity of >20 cSt at 40° C.;

an aniline point of at least 5° C.;

a pour point of less than 30° C.;

a sulfur content of <0.05 wt. %;

a Gardner color of <3; and a flash point of <160° C.

18. The method of claim 14, wherein the DCR has >25 wt. % aromatic, >40 wt. % naphthenic, and >15 wt. % paraffinic, all based on total weight of the DCR.

19. The method of claim 14, wherein the DCR has 30-60% wt. % aromatic; >40 wt. % naphthenic, and 20-35 wt. % paraffinic, all based on total weight of the DCR.

20. The method of claim 14, wherein the DCR comprises >60% by weight of tricyclic compounds as aromatics and cycloaliphatic.

* * * * *